United States Patent [19]

Moriya et al.

[11] Patent Number: 4,462,893

[45] Date of Patent: Jul. 31, 1984

[54] PROCESS FOR PRODUCING PITCH FOR USING AS RAW MATERIAL FOR CARBON FIBERS

[75] Inventors: Kunihiko Moriya, Tokyo; Kazuhito Tate, Kanagawa; Goro Muroga, Tokyo; Kazuhiro Yanagida, Kanagawa, all of Japan

[73] Assignee: Mitsubishi Oil Company, Ltd., Tokyo, Japan

[21] Appl. No.: 422,913

[22] Filed: Sep. 24, 1982

[30] Foreign Application Priority Data

Sep. 24, 1981 [JP] Japan ..... 56/149501

[51] Int. Cl.[3] ..... C10C 3/06; C10C 3/08

[52] U.S. Cl. ..... 208/40; 208/22; 208/39; 208/44; 208/45; 208/86; 208/96; 208/309; 423/447.4

[58] Field of Search ..... 208/22, 39, 40, 44, 208/45, 96, 309, 86; 423/447.2, 447.4, 447.6, 449

[56] References Cited

U.S. PATENT DOCUMENTS

| | | | |
|---|---|---|---|
| 2,010,423 | 8/1935 | Wells | 208/45 |
| 2,076,799 | 4/1937 | Thurston | 208/40 |
| 2,114,796 | 4/1938 | Crawley | 208/45 |
| 2,279,550 | 4/1942 | Benedict et al. | 208/57 |
| 2,889,262 | 6/1959 | Porter et al. | 208/309 |
| 2,931,766 | 4/1960 | Rausch | 208/45 |
| 3,358,049 | 12/1967 | Schneider | 208/92 |
| 3,380,912 | 4/1968 | Patterson | 208/86 |
| 3,767,741 | 10/1973 | Toyoguchi et al. | 423/447.4 |
| 3,779,896 | 12/1973 | Woodle | 208/309 |
| 3,816,295 | 6/1974 | Coleman et al. | 208/86 |
| 3,929,626 | 12/1975 | Button et al. | 208/309 |
| 3,968,023 | 7/1976 | Yan | 208/86 |
| 3,974,264 | 8/1976 | McHenry | 423/447.4 |
| 3,976,729 | 8/1976 | Lewis et al. | 264/29.7 |
| 4,005,183 | 1/1977 | Singu | 423/447.4 |
| 4,026,788 | 5/1977 | McHenry | 208/39 |
| 4,115,527 | 9/1978 | Otani et al. | 423/447.4 |
| 4,125,458 | 11/1978 | Bushnell et al. | 208/309 |
| 4,126,538 | 11/1978 | Goudriaan et al. | 208/92 |
| 4,165,274 | 8/1979 | Kwant | 208/86 |
| 4,219,404 | 8/1980 | Dickakian | 208/39 |

FOREIGN PATENT DOCUMENTS

| | | | |
|---|---|---|---|
| 161553 | 4/1953 | Australia | 208/86 |
| 782024 | 8/1957 | United Kingdom | 208/86 |

*Primary Examiner*—Delbert E. Gantz
*Assistant Examiner*—Helane E. Maull
*Attorney, Agent, or Firm*—Sughrue, Mion, Zinn, Macpeak, and Seas

[57] ABSTRACT

A process for producing a pitch which can be utilized as a raw material for producing carbon fibers is disclosed. The process involves distilling a petroleum heavy residual oil under reduced pressure to produce a reduced pressure distillation residual oil or a reduced pressure distillate oil. The distillation residual oil is subjected to a solvent deasphaltening treatment to produce a solvent deasphaltened oil. The solvent deasphaltened oil or the reduced pressure distillate oil is subjected to solvent extraction to obtain a solvent extraction component. The solvent extraction component is thermally modified to produce the pitch. The pitch can be utilized in a melt-spinning process in order to produce carbon fibers having desirable characteristics.

1 Claim, No Drawings

PROCESS FOR PRODUCING PITCH FOR USING AS RAW MATERIAL FOR CARBON FIBERS

FIELD OF THE INVENTION

The present invention relates to a process for producing pitch (which is a raw material for producing carbon fibers having a high modulus of elasticity), using a petroleum heavy residual oil.

BACKGROUND OF THE INVENTION

In pitches which are used as a raw material for producing carbon fibers having excellent strength and excellent modulus of elasticity, optical anisotropy is observed by a polarizing microscope. More specifically, such pitches are believed to contain a mesophase as described in U.S. Pat. No. 3,974,264. Further, it has recently been disclosed in Japanese Patent Application (OPI) No. 160427/79 (the term "OPI" as used herein refers to a "published unexamined Japanese patent application") that carbon fibers having a high modulus of elasticity can be produced with a pitch containing a neomesophase. By heating such pitches for a short time optical anisotropy is observed in them. Further, pitches used as a raw material for carbon fibers need not possess only optical anisotropy but must also be capable of being stably spun. However, it is not easy to produce pitches having both properties. In order to produce carbon fibers having excellent strength and excellent modulus of elasticity, it is not always possible to use any material as the raw material for making pitches. Materials having specified properties have been required.

It should be noted that in many published patents, for example, as described in U.S. Pat. Nos. 3,976,729 and 4,026,788, the raw material is not specified in the claims of patent specifications. Furthermore, such patents indicate that pitches used as a raw material for carbon fibers can be produced only by carrying out thermal modification of a wide variety of raw materials. However, according to the detailed descriptions and examples in such patents, the desired pitches can only be produced by using specified raw materials.

For example, U.S. Pat. No. 4,115,527 discloses that substances such as chrysene, etc., or tarry materials by-produced in high temperature cracking of petroleum crude oil are suitable for producing the pitch, i.e., a carbon fiber precursor, but conventional petroleum asphalts and coal tar pitches are not suitable. Further, U.S. Pat. No. 3,974,264 discloses that an aromatic base carbonaceous pitch having a carbon content of about 92 to about 96% by weight and a hydrogen content of about 4 to about 8% by weight is generally suitable for controlling a mesophase pitch. It has been described that elements excepting carbon and hydrogen, such as oxygen, sulfur and nitrogen, should not be present in an amount of more than about 4% by weight, because they are not suitable. Further, Example 1 of the same patent publication discloses that the precursor pitch has properties comprising a density of 1.23 g/cc, a softening point of 120° C., a quinoline insoluble content of 0.83% by weight, a carbon content of 93.0%, a hydrogen content of 5.6%, a sulfur content of 1.1% and an ash content of 0.044%. Even if a density of 1.23 g/cc in these properties is maintained, it should be noted that it is difficult to obtain conventional petroleum heavy oil having such a high density. Examples as described in the other U.S. Pat. Nos. 3,976,729, 4,026,788 and 4,005,183 also disclose that the pitch is produced with a specified raw material.

The properties of heavy petroleum oils depend essentially upon the properties of crude oils from which they were produced and the process for producing the heavy oil. However, generally, it is rare that heavy oils having the suitable properties described in the above described Examples are produced, and, in many cases, they cannot be obtained. Accordingly, in order to produce carbon fibers industrially in a stabilized state, which have excellent strength and excellent modulus of elasticity with petroleum heavy oils, it is necessary to develop a process for producing a pitch wherein the finally resulting pitch has properties which are always within a specified range even if the properties of the raw material for the pitch vary.

SUMMARY OF THE INVENTION

Therefore, one object of this invention is to provide a process for producing a pitch useful as raw material for carbon fibers having an excellent strength and a high modulus of elasticity.

Another object is to provide a process for producing a pitch which can be used for producing carbon fibers having the above excellent properties industrially in a stabilized state.

Still another object is to provide a process for producing a pitch used as raw material for carbon fibers with an easily available petroleum heavy residual oil.

These objects of this invention are effectively accomplished with a process for producing a pitch used as a raw material for carbon fibers which comprises carrying out solvent extraction of a solvent deasphaltened oil which is prepared by solvent deasphaltening of a reduced pressure distillation residual oil prepared by reduced pressure distillation of a petroleum heavy residual oil, or solvent extraction of a reduced pressure distillate oil prepared by reduced pressure distillation of the petroleum heavy residual oil. The resulting solvent extraction component which is rich in aromatic components is then thermally modified.

DETAILED DESCRIPTION OF THE INVENTION

Examples of petroleum heavy residual oils which are used as a raw material include heavy residual oils such as atmospheric pressure distillation residual oils of crude oil, hydrogenating desulfurization residual oils, hydrocracking residual oils, thermal cracking residual oils and catalytic cracking residual oils. A distillate having a boiling point of 300° to 550° C. at atmospheric pressure and a reduced pressure residual oil having a boiling point of higher than 500° C. at atmospheric pressure are taken out of the petroleum heavy residual oil by means of a reduced pressure distillation apparatus conventionally used in the field of petroleum industry. Then, the reduced pressure residual oil having a boiling point higher than 500° C. prepared by reduced pressure distillation is subjected to solvent deasphaltening treatment to remove an asphaltene component which contains vanadium and nickel, etc., in large amounts. The solvent deasphaltening treatment is carried out with saturated hydrocarbon compounds having 3 to 5 carbon atoms, e.g., one or more of propane, butane and pentane, as a solvent under a condition comprising a ratio of solvent to oil of 3 to 15:1, a temperature of 50° to 150° C. and a pressure of 5 to 50 kg/cm$^2$G, by which a deasphaltened oil is taken out. Then, the deasphaltened oil is subjected to solvent extraction treatment with furfural as a solvent to obtain a component (extract) which is rich in aromatic components.

The furfural extraction treatment is carried out under conditions comprising a ratio of solvent to oil of 1 to 4:1, a temperature of 45° to 145° C. and a pressure of 0.1 to 2.0 kg/cm$^2$G. If necessary, the distillate oil having a boiling point of 300° to 550° C. prepared by reduced pressure distillation can be subjected to furfural extraction treatment without carrying out deasphaltening treatment. The specific conditions necessary for obtaining the best results for the reduced pressure distllation, deasphaltening treatment and furfural extraction treatment depend on the properties of the raw material and properties of the extraction component. By carrying out a series of these processes, differences in properties become small, even if there are great differences in properties of the raw material, by which the properties become suitable for carrying out the subsequent thermal modification.

The resulting furfural extraction component is then subjected to thermal modification at a temperature of 390° to 450° C. for 1 to 30 hours to produce a pitch used as a raw material for carbon fibers having high modulus of elasticity. The thermal modification period is necessary for control so that no infusible substances are formed which obstruct spinning when carrying out melt-spinning of the pitch.

The properties of the petroleum heavy residual oils used as the raw material vary largely each other. Accordingly, it is generally difficult to produce pitch which can be used as a raw material for making carbon fibers having high strength and high modulus of elasticity directly from every kind of petroleum heavy residual oil by only carrying out the thermal modification. However, some oils can be used for directly producing pitch which is used as a raw material for carbon fibers having high strength and high modulus of elasticity. The present invention is characterized by the fact that a pitch used as a raw material for making carbon fibers can be produced industrially and stably with various kinds of petroleum heavy residual oils. Useful oils include petroleum heavy residual oils which cannot yield a pitch which is useful as a raw material for making carbon fibers by only the conventional thermal modification. However, such oil can be made useful by carrying out a series of processings comprising reduced-pressure distillation→solvent deasphaltening→furfural extraction→thermal modification.

In the following, the present invention is illustrated in greater detail by examples. However, this invention is not limited to these examples.

EXAMPLE 1

An atmospheric pressure distillation residual oil was prepared by distilling Middle East crude oil A by an atmospheric pressure distillation apparatus. The residual oil was subjected to reduced pressure distillation to take out a fraction having a boiling point of higher than 500° C. The resulting reduced pressure distillation residual oil was subjected to solvent deasphaltening treatment with propane as a solvent under conditions comprising a ratio of solvent to oil of 6:1, a temperature of 75° C. and a pressure of 40 kg/cm$^2$G to take out a deasphaltened oil. The resulting deasphaltened oil was subjected to solvent extraction treatment with furfural as a solvent under conditions comprising a ratio of solvent to oil of 3:1, a temperature of 120° C. and a pressure of 0.5 kg/cm$^2$G. The resulting extraction component was subjected to thermal modification at a temperature of 410° C. for 15 hours to obtain a pitch which can be used as a raw material for making carbon fibers.

The properties of the atmospheric distillation residual oil of Middle East crude oil A used as a raw material and the properties of the extraction component after the furfural extraction treatment as well as the properties of the pitch which can be used as a raw material for carbon fibers are shown in Table 1. Further, carbon fibers which were obtained by melt-spinning of the above described pitch at 370° C., infusiblizing at 260° C. in air and carbonizing at 1,000° C. had a tensile strength of 9 tons/cm$^2$ and a modulus of elasticity of 900 tons/cm$^2$. When carbonized fibers prepared by carbonizing at 1,000° C. were additionally graphitized at 1,900° C., they had a tensile strength of 13 tons/cm$^2$ and a modulus of elasticity of 2,200 tons/cm$^2$.

EXAMPLE 2

An atmospheric pressure distillation residual oil was prepared by distilling Middle East crude oil B by an atmospheric pressure distillation apparatus. The residual oil was subjected to reduced pressure distillation to take out a fraction having a boiling point above 500° C. The resulting reduced pressure distillation residual oil was subjected to solvent deasphaltening treatment with propane as a solvent under conditions comprising a ratio of solvent to oil of 6:1, a temperature of 76° C. and a pressure of 40 kg/cm$^2$G to take out a deasphaltened oil. The resulting deasphaltened oil was subjected to solvent extraction treatment with furfural as a solvent under conditions comprising a ratio of solvent to oil of 3.5:1, a temperature of 120° C. and a pressure of 0.5 kg/cm$^2$G. The resulting extraction component was subjected to thermal modification at a temperature of 405° C. for 17 hours to obtain a pitch which can be used as a raw material for making carbon fibers.

The properties of the atmospheric distillation residual oil of Middle East crude oil B used as a raw material, and the properties of the extraction component after the furfural extraction treatment as well as the properties of the pitch which can be used as a raw material for carbon fibers are shown in Table 1. Further, carbon fibers which were obtained by meltspinning of the above described pitch at 345° C., infusiblizing at 260° C. in air and carbonizing at 1,000° C. had a tensile strength of 9.5 tons/cm$^2$ and a modulus of elasticity of 850 tons/cm$^2$. When carbonized fibers prepared by carbonizing at 1,000° C. were additionally graphitized at 1,900° C., they had a tensile strength of 13 tons/cm$^2$ and a modulus of elasticity of 2,250 tons/cm$^2$.

EXAMPLE 3

An atmospheric pressure distillation residual oil was prepared by distilling Middle East crude oil A by an atmospheric pressure distillation apparatus. The residual oil was subjected to reduced pressure distillation to take out a fraction having a boiling point of 390° to 450° C. The resulting reduced pressure distillate oil was subjected to solvent extraction treatment with furfural as a solvent under conditions comprising a ratio of solvent to oil of 1.2:1, a temperature of 110° C. and a pressure of 0.5 kg/cm$^2$G. The extraction component was subjected to thermal modification at a temperature of 420° C. for 10 hours to obtain a pitch which can be used as a raw material for making carbon fibers.

The properties of the atmospheric distillation residual oil of Middle East crude oil A used as a raw material, and the properties of the extraction component after furfural extraction treatment as well as the properties of the pitch which can be used as a raw material for carbon fibers are shown in Table 1. Further, carbon fibers which were obtained by melt-spinning of the above described pitch at 350° C., infusiblizing at 260° C. in air and carbonizing at 1,000° C. had a tensile strength of 10 tons/cm$^2$ and a modulus of elasticity of 820 tons/cm$^2$. When carbonized fibers prepared by carbonizing at 1,000° C. were additionally graphitized at 1,900° C., they had a tensile strength of 14 tons/cm$^2$ and a modulus of elasticity of 2,300 tons/cm$^2$.

COMPARATIVE EXAMPLE 1

An atmospheric pressure residual oil of the Middle East crude oil A was subjected to thermal modification at a temperature of 410° C. for 15 hours. The properties of the atmospheric pressure distillation residual oil of the Middle East crude oil A used as a raw material and those of the pitch are shown in Table 1. Further, fibers which were prepared by melt-spinning the pitch at 370° C., infusiblizing in air and carbonizing at 1,000° C. had a tensile strength of 3.0 tons/cm$^2$ and a modulus of elasticity of 250 tons/cm$^2$. When the fibers prepared by carbonizing at 1,000° C. were additionally graphitized at 1,900° C., they had a tensile strength of 2.8 tons/cm$^2$ and a modulus of elasticity of 240 tons/cm$^2$.

TABLE 1

| | Example 1 | Example 2 | Example 3 | Comparative Example 1 |
|---|---|---|---|---|
| Properties of raw material | | | | |
| Specific gravity @ 15/4° C. | 0.955 | 0.982 | 0.955 | 0.955 |
| Kinematic viscosity cSt @ 50° C. | 230 | 1,344 | 230 | 230 |
| Residual carbon content (wt %) | 8.5 | 13.73 | 8.5 | 8.5 |
| Sulfur content (wt %) | 3.0 | 4.3 | 3.0 | 3.0 |
| Carbon content (wt %) | 85.2 | 84.3 | 85.2 | 85.2 |
| Hydrogen content (wt %) | 11.2 | 10.6 | 11.2 | 11.2 |
| Ash (wt %) | 0.01 | 0.02 | 0.01 | 0.01 |
| Properties of furfural extraction component | | | | |
| Specific gravity @ 15/4° C. | 0.990 | 1.01 | 1.02 | |
| Kinematic viscosity cSt @ 50° C. | 1.629 | 744 | 210 | |
| Residual carbon content (wt %) | 6.8 | 10.2 | 0.56 | |
| Sulfur content (wt %) | 4.0 | 5.0 | 5.1 | |
| Carbon content (wt %) | 82.2 | 84.0 | 84.1 | |
| Hydrogen content (wt %) | 10.3 | 10.5 | 10.1 | |
| Ash (wt %) | 0.00 | 0.00 | 0.00 | |
| Properties of pitch | | | | |
| Specific gravity @ 25/25° C. | 1.31 | 1.30 | 1.30 | 1.30 |
| Softening point (°C.) | 330 | 315 | 320 | 330 |
| Quinolin insoluble content (wt %) | 28.1 | 26.2 | 25.6 | 35.4 |

While the invention has been described in detail and with reference to specific embodiments thereof, it will be apparent to one skilled in the art that various changes and modifications can be made therein without departing from the spirit and scope thereof.

What is claimed is:

1. A process for producing a pitch, which comprises the steps of:

distilling a petroleum heavy residual oil under reduced pressure to produce a reduced pressure distillation residual oil having a boiling point of 500° C. or more at atmospheric pressure;

deasphaltening the reduced pressure distillation residual oil using a solvent comprising at least one saturated hydrocarbon compound having 3 to 5 carbon atoms wherein the ratio of the solvent to oil is from 3:1 to 15:1, the temperature is between 50° C. to 150° C. and the pressure is between 5 to 50 kg/cm$^2$G;

extracting the solvent deasphaltened oil using a furfural solvent at a temperature of 45° to 145° C. at a pressure of 0.1 to 2.0 kg/cm$^2$G, the ratio of the furfural solvent to oil being from 1:1 to 4:1; and thermally modifying the solvent extractions component extract at a temperature of 390° to 450° C. for 1 to 30 hours.

* * * * *